United States Patent [19]

Ohsawa et al.

[11] Patent Number: 4,676,216

[45] Date of Patent: Jun. 30, 1987

[54] INJECTION NOZZLE

[75] Inventors: Katsuyuki Ohsawa; Hiromitsu Kawazoe; Susumu Nagano, all of Aichi, Japan

[73] Assignee: Kabushiki Kaisha Toyota Chuo Kenkyusho, Aichi, Japan

[21] Appl. No.: 784,063

[22] Filed: Oct. 4, 1985

[30] Foreign Application Priority Data

Oct. 5, 1984 [JP] Japan ..... 59-209550

[51] Int. Cl.[4] ..... F02M 23/00

[52] U.S. Cl. ..... 123/533; 239/412; 239/418; 239/585

[58] Field of Search ..... 239/407, 408, 412, 413, 239/424, 444, 101, 102, 422, 433, 543, 545, 381, 382, 538; 137/614.13, 614.15, 614.16; 123/531, 537, 585, 470, 472

[56] References Cited

U.S. PATENT DOCUMENTS

| | | | |
|---|---|---|---|
| 1,143,778 | 6/1915 | Pembroke | 137/614.16 X |
| 1,699,623 | 1/1929 | Novak | 239/214.4 X |
| 2,697,007 | 12/1954 | Willie | 239/412 X |
| 2,709,976 | 4/1955 | Gianni | 123/533 X |
| 2,765,027 | 10/1956 | Trimble | 239/412 X |
| 3,853,456 | 12/1974 | Mutchler | 239/214.21 X |

FOREIGN PATENT DOCUMENTS

| | | | |
|---|---|---|---|
| 1145312 | 1/1956 | France | 239/214.21 |

*Primary Examiner*—Andres Kashnikow
*Assistant Examiner*—Kevin Patrick Weldon
*Attorney, Agent, or Firm*—Sughrue, Mion, Zinn, Macpeak & Seas

[57] ABSTRACT

An injection nozzle comprises: a nozzle body arranged in a case in such a manner that the nozzle body is movable along the axis thereof; an injection outlet for jetting fuel when said nozzle body is moved along the axis to open the injection outlet; at least one fluid jetting outlet which is communicated through a fluid supply passage to a fluid supply device, for jetting fluid towards the fuel thus jetted; and a control unit having at least one stationary opening and a movable opening to supply fluid to the fluid jetting outlet when the stationary and movable openings are aligned with each other, to thereby control fluid jetted from the fluid jetting outlet. The fluid jetted from the fluid jetting outlet is applied to the fuel jetted by the injection outlet, to cause the kinetic energy of the fluid to shear the fuel and to thereby improve the atomization of fuel, and to control a fuel scattering direction and a fuel spray pattern.

9 Claims, 30 Drawing Figures

INJECTION NOZZLE

FIELD OF THE INVENTION AND RELATED ART STATEMENT

This invention relates to an injection nozzle adapted to inject fuel to be burnt in an engine.

In an automobile engine, an electronic fuel injection nozzle is employed to supply fuel, because it can provide high power and is effective in preventing air contamination due to exhaust gas.

An injection nozzle is installed at the pipe-collected part of the suction manifold, or injection nozzles are installed near the inlets of combustion chambers, respectively.

In any of the above-described cases, the fuel injection timing and the fuel injection quantity are suitably controlled so that the fuel mixed with the air delivered by the air cleaner is supplied to the engine. For this purpose, the fuel jetted by the fuel injection nozzle should be satisfactorily atomized.

However, in practice, it is difficult to sufficiently atomize the fuel. In order to overcome this difficulty, an injection nozzle has been proposed in which the fuel is swirled in advance, or, as shown in FIG. 20, air flow jetting outlets 12 are provided around a fuel nozzle 10 in such a manner that they are perpendicular to the axis of the fuel nozzle 10, so that the air flows jetted therefrom are applied to the jetted fuel, thus atomizing the latter. The air flow jetting outlets 12 are provided coaxially with the fuel nozzle 10. Accordingly, as shown in FIG. 21, the air flows 14 jetted surround the fuel spray 16 while flowing in the direction of fuel injection. Since a shearing force attributing to the difference in velocity between the fuel spray and the air flow (cf. FIG. 22) contributes to atomization of the fuel, atomization of the fuel in the conventional injection nozzle is insufficient. Furthermore, since the air flows 14 are jetted at all times, a large amount of air is consumed.

In order to deliver the jetted fuel quickly to the combustion chamber, it is desirable that the injection nozzle jets fuel near the combustion chamber. However, since the fuel is insufficiently atomized, distribution of the fuel is also insufficient, and accordingly it is impossible to continue the stable operation of the engine.

Also in a so-called "single point injection system" in which one injection nozzle is used, atomization of the fuel jetted by the injection nozzle is insufficient. Therefore, if the fuel is jetted downstream of the throttle nozzle, distribution of the fuel to the cylinders becomes non-uniform, as a result of which it is difficult to continue the stable operation of the engine. Accordingly, the injection nozzle is provided upstream of the throttle valve in many cases.

In some of the engines, the air flow in the combustion chamber is utilized to disperse the jetted fuel. However, a mixed gas extremely high in density is formed in the central portion of the jetted fuel thus dispersed, as a result of which the combustion becomes unsatisfactory, thus creating a large quantity of waste material such as soot, while generation of required heat is interrupted.

OBJECT AND SUMMARY OF THE INVENTION

In view of the foregoing, an object of the invention is to provide an injection nozzle in which atomization of the fuel is improved, and a fuel scattering direction and a fuel spray pattern can be controlled.

An injection nozzle of the invention comprises: an injection outlet for injecting fuel or the like; at least one fluid jetting outlet for jetting fluid towards the fuel jetted by the injection outlet; and control means for controlling the fluid jetted from the fluid jetting outlet. Accordingly, the jetted fluid which is controlled by the control means is applied to the fuel jetted by the injection outlet, to cause the kinetic energy of the fluid to shear the fuel and thereby to improve the atomization of fuel, and to control a fuel scattering direction and a fuel spray pattern.

In one preferred embodiment of the invention, the control means comprises at least one stationary opening and a movable opening to supply fluid to the fluid jetting outlet when the stationary and movable openings are aligned with each other.

Accordingly, the fluid jetting outlet is opened only when necessary, which reduces the consumption of fluid. Furthermore, by opening the fluid jetting outlet intermittently, injection of the fuel can be made in synchronization with the rotation of the engine, the fuel spraying direction can be controlled, and distribution of the fuel to the combustion engine can be improved. In an engine of the type that fuel is injected into the suction pipe, suitable control of the distribution of mixed gas in the combustion chamber makes it possible to improve the ignition of the mixed gas and to reduce the quantity of hazardous waste material which is created in the high-density part of the mixed gas.

The above-described intermittent injection of fuel can be readily achieved by a method in which a movable opening is formed in a part of the rotary plate or cylinder which is arranged coaxial with the injection outlet, or by a method in which a plurality of stationary openings are formed around the injection outlet, and the stationary openings are aligned with the movable opening one after another.

In another embodiment of the invention, a control fluid pressurizing pump is made integral with an injection nozzle body, thereby to reduce the amount of control fluid which leaks from the periphery of a rotary switching plate in the case where the control fluid pressurizing pump is not integral with the injection nozzle body, to simplify the power transmission system, to decrease a loss in power transmission, and to improve the response in switch the control fluid.

DETAILED DESCRIPTION OF PREFERRED EMBODIMENTS

Figure 1:
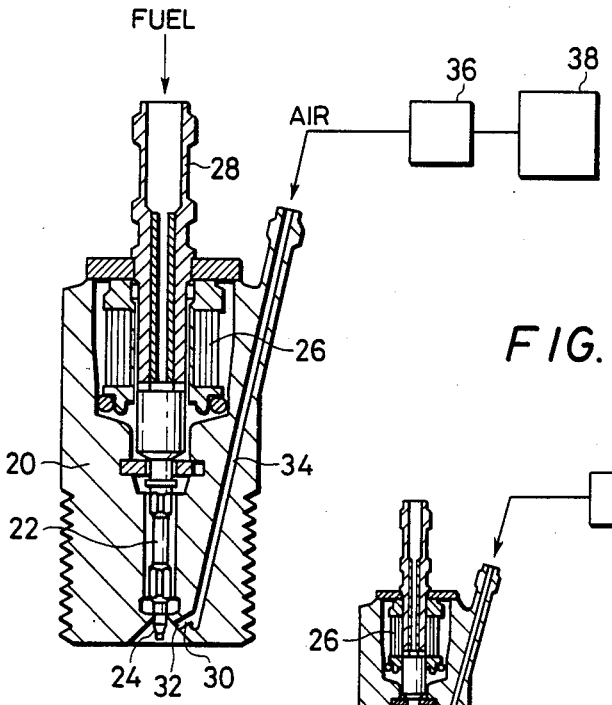
FIG. 1 is a sectional view showing an injection nozzle which is the first embodiment of this invention.

FIG. 1 shows the first embodiment of this invention. In the injection nozzle, its nozzle body 22 is inserted in a case 20 in such a manner that it is movable along the axis into and out of engagement with a fuel injection outlet 24.

Although the nozzle body 22 is pushed towards the fuel injection outlet 24 by an elastic force, it is moved in the axial direction by a coil 26 set in the case 20. Therefore, when the nozzle body 22 is moved away from the fuel injection outlet 24, the outlet 24 is opened. As a result, fuel delivered through a fuel supplying pipe 28 to the fuel injection outlet 24 is jetted through the outlet 24.

An air guide hole 30 is formed in the case 20 in such a manner that its axis intersects the axial direction (vertical direction in FIG. 1) of the fuel injection outlet 24. The end portion of the air guide hole 30 is a jetting outlet 32 which is opened near the fuel injection outlet 24. The air guide hole 30 is communicated with an air supply source 38 through an air guide pipe 34 and a control nozzle 36.

The axis of the air jetting outlet 32 forms an acute angle with the direction of fuel injection of the fuel injection outlet 24. Therefore, the air jetted through the air jetting outlet 32 gives a shearing force to the fuel jetted through the fuel injection outlet 24, while going across the fuel thus jetted.

Figure 2:
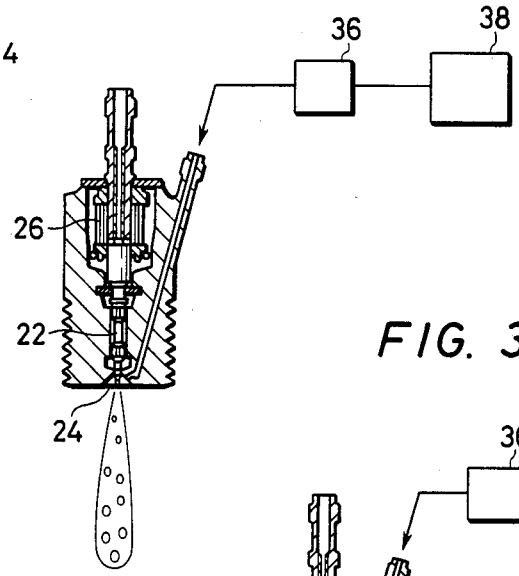
FIG. 2 is an explanatory diagram showing a state of injection of the injection nozzle of the first embodiment in which fuel is not atomized.

In the embodiment, when the coil 26 is energized with the control nozzle 36 closed, the nozzle body 22 is moved to open the fuel injection outlet 24, as a result of which the fuel is sprayed in the axial direction of the fuel injection outlet 24 as shown in FIG. 2. In this case, the fuel droplets are large in diameter.

Figure 3:
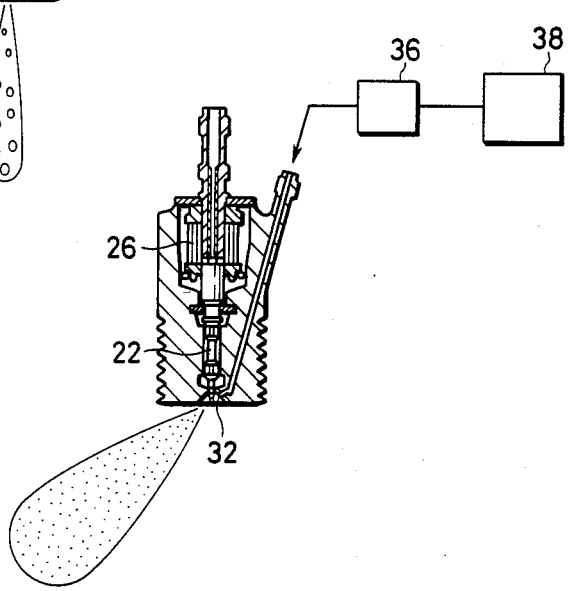
FIG. 3 is an explanatory diagram showing another state of injection of the injection nozzle of the first embodiment in which the fuel is atomized by fluid jet.

When, as shown in FIG. 3, the air from the air supply source 38 is jetted through the air jetting outlet 32 with the control nozzle 36 opened, the air thus jetted collides with the fuel jetted from the fuel injection outlet 24, thus atomizing the fuel into the spray of fuel in which the fuel droplets are small in diameter. In this case, the direction of the spray of fuel jetted from the fuel injection outlet 24 is bent from the axis of the fuel injection outlet by the air jetted from the air jetting outlet 32.

The opening degree of the control nozzle 36, and the timing of operating the same can be freely adjusted. In addition, the direction of spraying fuel can be suitably controlled by adjusting the axial direction of the air jetting outlet 32.

It goes without saying that, instead of the coil 26, a mechanical drive device may be used to operate the nozzle body 22.

Figure 4:
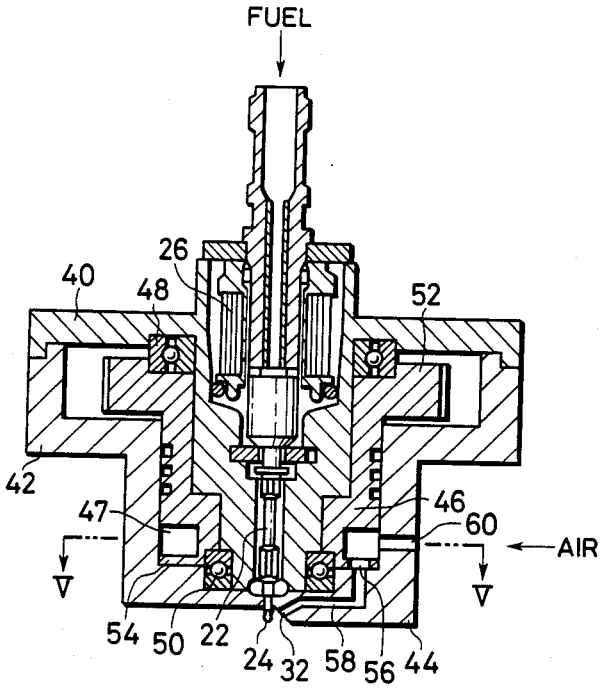
FIG. 4 is a sectional view showing an injection nozzle which is the second embodiment of the invention.
Figure 5:
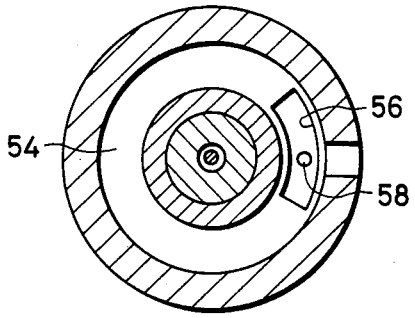
FIG. 5 is a sectional view taken along line V—V in FIG. 4.

FIGS. 4 and 5 show the second embodiment of the invention.

The fuel injection nozzle comprises an upper case 40 and a lower case 42. Similarly as in the first embodiment, a nozzle body 22 and a coil 26 are arranged in the upper case 40 so that, when the coil 26 is energized, the nozzle body 22 is moved in the axial direction.

The lower case 42 is arranged coaxially with the upper case 40. The lower end portion of the lower case 42 has a fuel injection outlet 24 with which the end portion of the nozzle body 22 is engaged. The lower case 42 has a rise 44 on the lower end face. An air injecting outlet 32 is formed in the rise 44. The positional relationship between the air injecting outlet 32 and the fuel injection outlet 24 is the same as that in the first embodiment.

There is a space between the upper and lower cases 40 and 42, and a rotary cylinder 46 is provided in the space. The axial part of the upper case 40 is inserted into the rotary cylinder 46. The upper end portion of the cylinder 46 is supported through a bearing 48 by the upper case 40, while the lower end portion is supported through a bearing 50 by the lower case 42, so that the rotary cylinder is rotatable coaxially with the fuel injection outlet 24.

A gear 52 is formed in the periphery of the upper end portion of the cylinder 46, and the gear 52 is engaged with a timing belt (not shown) which is driven by a motor (not shown) or an engine crank shaft (not shown).

A rotary plate 54 extended radially is provided beneath the lower end of the rotary cylinder 46 in such a manner that it is integral with the cylinder 46. A sector-shaped movable opening 56 is formed in the rotary plate 54. The opening 56 confronts an air guide hole 58 which has one end communicated with the annular air chamber 47 defined by the lower case 42 and the rotary cylinder 46 and the other end communicated with the air jetting outlet 32. Therefore, while the rotary plate 54 is rotating, the movable opening 56 repeatedly shuts and opens the air guide hole 58. When the opening 56 aligns with the air guide hole 58, the air delivered from the air supply source through an air guide port 60 into the air chamber 47 is sent to the air jetting outlet 32.

Figure 6:
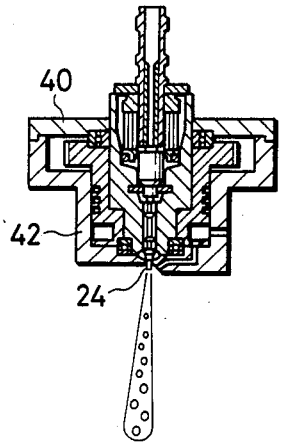
FIG. 6 is an explanatory diagram showing a state of injection of the injection nozzle of FIG. 5 in which the fuel is not atomized.
Figure 7:
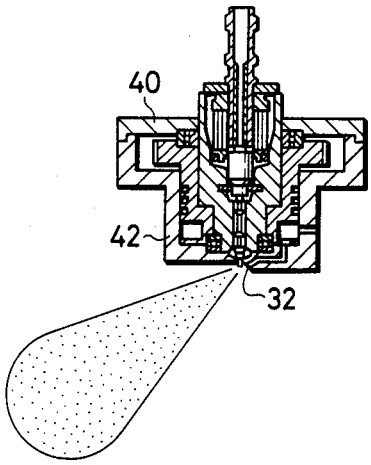
FIG. 7 is an explanatory diagram showing another state of injection of the injection nozzle of FIG. 5 in which the fuel is atomized by fluid jet.
Figure 8:
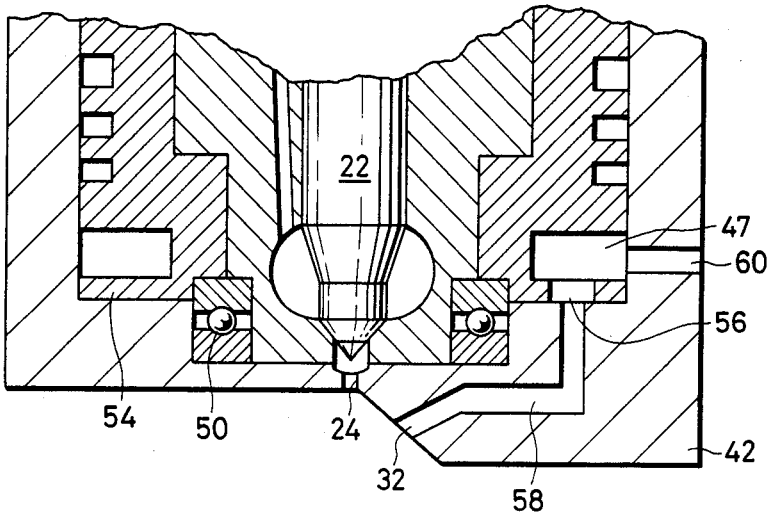
FIG. 8 is an enlarged diagram showing essential components of a mechanical injection nozzle which is formed according to the technical concept of the second embodiment of the invention.

Accordingly, in the second embodiment, when the rotation of the rotary cylinder 46 does not coincide with the fuel injection of the fuel injection outlet 24, the fuel is sprayed in the axial direction of the fuel injection outlet 24 as shown in FIG. 6, and the fuel droplets in the spray are relatively large in diameter. On the other hand, when the air injection of the air jetting outlet 32 coincides with the fuel injection of the fuel injection outlet 24, the fuel atomized is sprayed in a different direction as shown in FIG. 7.

In the second embodiment, the control of air supply by the movable opening 56 is carried out near the air jetting outlet 32, and therefore the air split flow satisfactorily follows the opening and closing of the air flow path. Accordingly, two kinds of spray conditions as shown in FIGS. 6 and 7 can be obtained alternately at time intervals of less than about 0.01 second. Thus, the second embodiment can be controlled at high speed when compared with the first embodiment in which two kinds of spray conditions as shown in FIGS. 2 and 3 are obtained alternately at time intervals of less than about 0.03 second.

Figure 9:
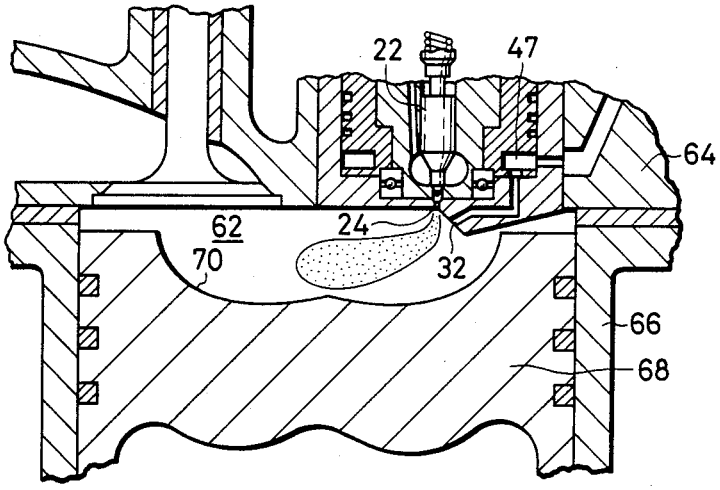
FIG. 9 is a sectional view showing the injection nozzle of the second embodiment which is arranged in the combustion chamber.

FIG. 9 shows the fuel injection nozzle of the second embodiment which is installed in the combustion chamber 62. The combustion chamber 62 is made up of a cylinder head 64, a cylinder 66, and a piston 68 moved up and down. The injection nozzle is protruded inside the combustion chamber 62 through the cylinder head 64 so that it is directed towards a part of the recess 70 formed in the top of the piston 68. The direction of injection is so bent that fuel atomized by the air jetted from the air jetting outlet 32 spreads in the entire recess 70.

Figure 10A:
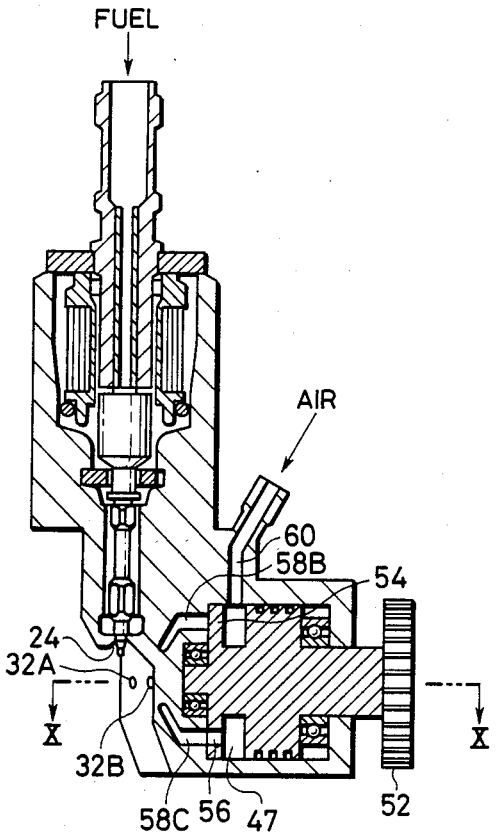
FIG. 10(a) is a sectional view showing the third embodiment of the invention.
Figure 10B:
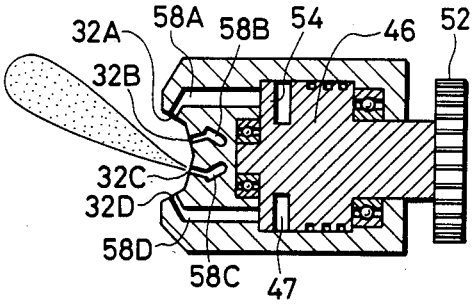
FIG. 10(b) is a sectional diagram taken along line X—X in FIG. 10(a)

FIGS. 10(a) and 10(b) show a third embodiment of the invention. In the embodiment, four air jetting outlets 32 are arranged at equal intervals and at equal distances from the axis of the fuel injection outlet 24 in a plane perpendicular to the axis of the fuel injection outlet 24.

The air jetting outlets 32B and 32C are disposed between the air jetting outlets 32A and 32D, and are communicated respectively through air guide holes 58B and 58C to the air chamber 47.

The parts of the air guide holes 58A to 58D to which the latter 58A through 58D are communicated with the air chamber 47 are arranged at equal distances from the axis of the rotary plate 54 as viewed along the axis of the rotary plate 54. Accordingly, whenever the angle of rotation of the rotary plate 54 increases by 45°, the movable opening 56 is communicated with the air guide holes 58A to 58D one by one to allow the air jetting outlets 32A to 32D to successively jet the air, so that the direction of atomized fuel spray is changed.

Figure 11A:
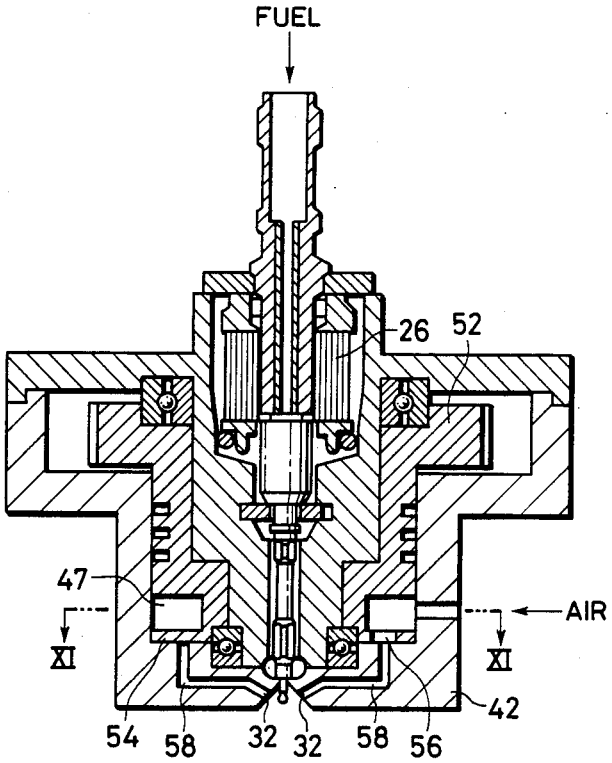
FIG. 11(a) is a sectional view showing the fourth embodiment of the invention.
Figure 11B:
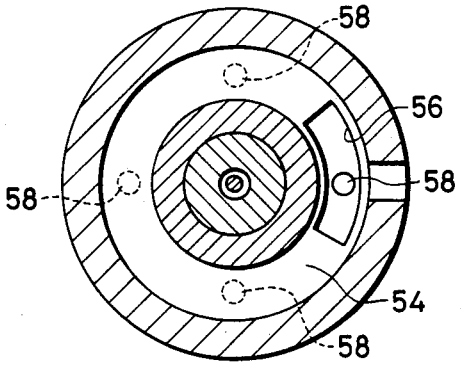
FIG. 11(b) is a cross-sectional view taken along line XI—XI in FIG. 11(a)

FIG. 11(a) shows a fourth embodiment of the invention. In the embodiment, four air jetting outlets 32 similar to that in the second embodiment are arranged at equal intervals around a fuel injection outlet 24, and are communicated with air guide holes 58, respectively. The other ends of the air guide holes 58 are intermittently communicated with the movable opening 56 when the rotary plate 54 turns.

Accordingly, in the embodiments, as the rotary plate 54 is rotated, the direction of atomized fuel spray is changed sequentially in four directions around the injection outlet 24.

Figure 12:
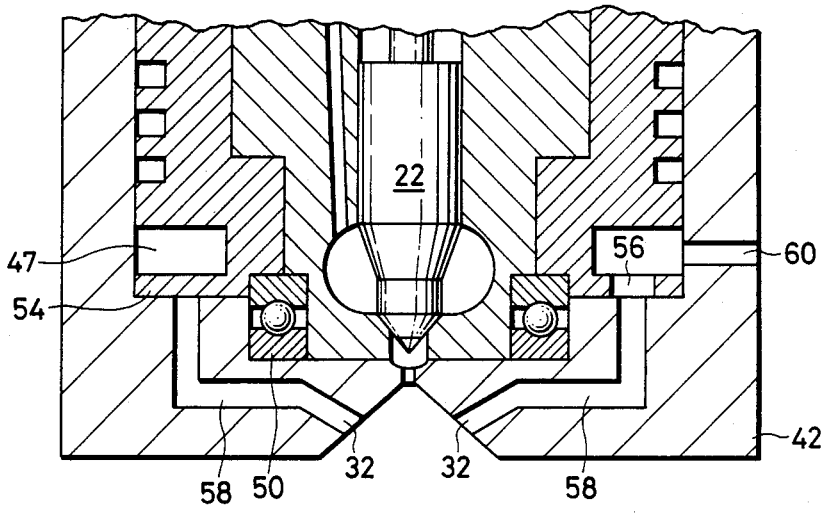
FIG. 12 is an enlarged diagram showing essential components of a mechanical injection nozzle which is formed according to the technical concept of the fourth embodiment of the invention.
Figure 13A:
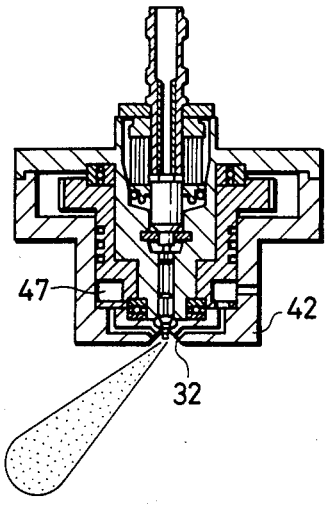
FIGS. 13 through 16 are sectional view for a description of the operation of the injection nozzle shown in FIG. 11.
Figure 13B:
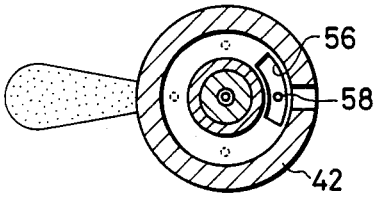
Figure 14A:
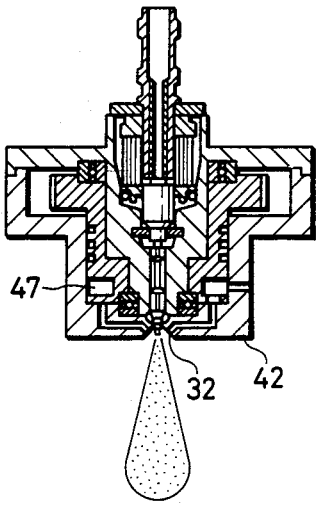
Figure 14B:
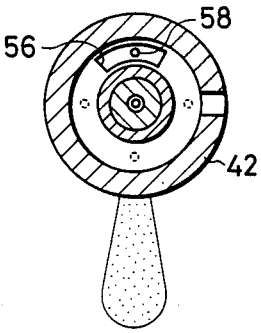
Figure 15A:
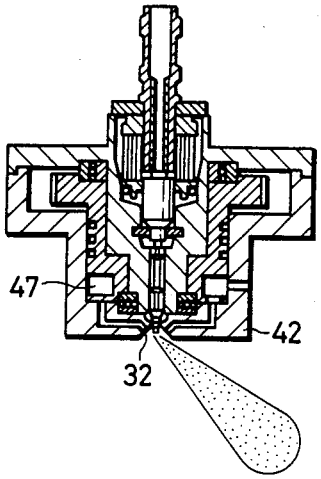
Figure 15B:
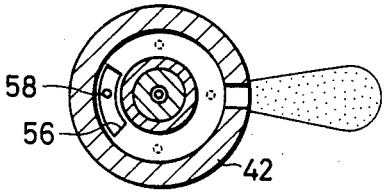
Figure 16A:
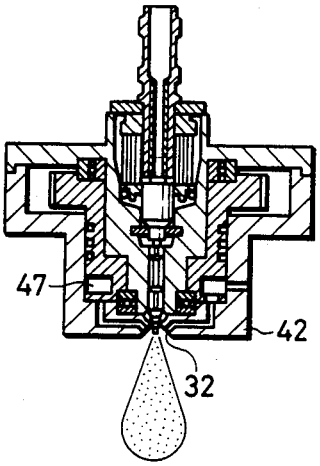
Figure 16B:
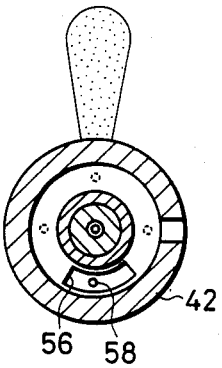

FIG. 12 is an enlarged view of the end portion of a mechanical injection nozzle which is formed by utilizing the technical concept of the injection nozzle shown in FIG. 11(a).

Figure 17:
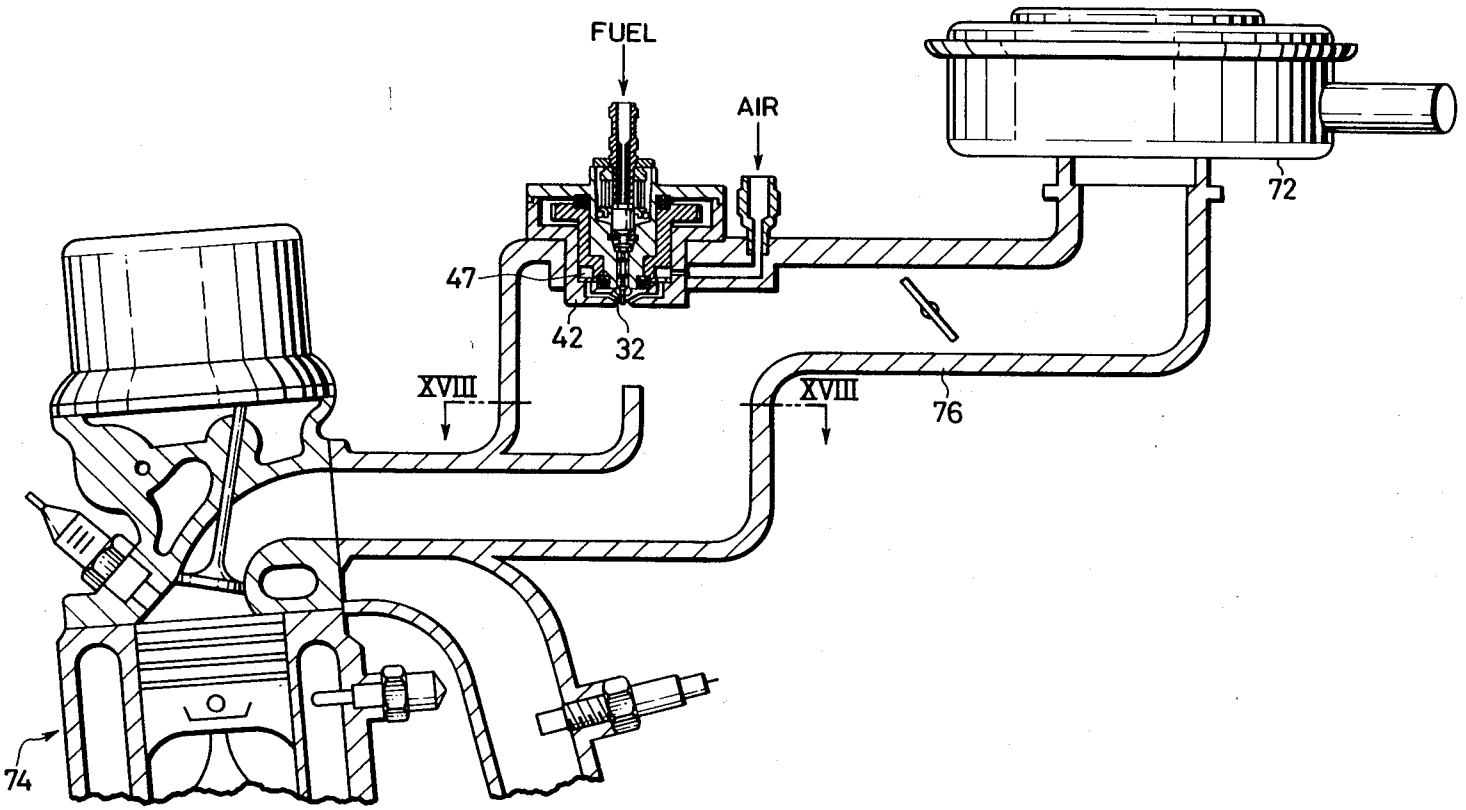
FIG. 17 is a sectional view showing the injection nozzle of the fourth embodiment which is installed between an engine and its air cleaner.
Figure 19:
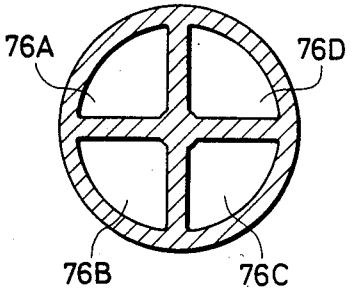
FIG. 19 is a sectional view taken along XVIII—XVIII in FIG. 17.
Figure 20:
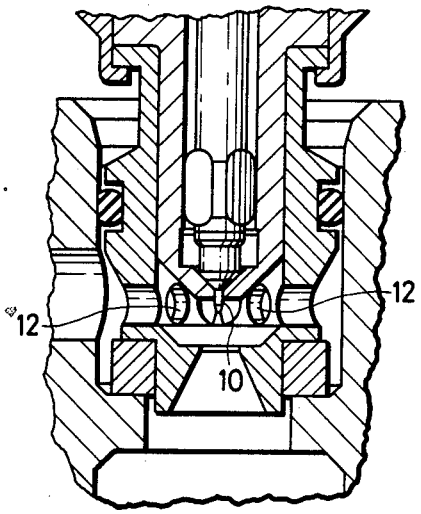
FIG. 20 PRIOR ART
FIG. 20 is a sectional view of a conventional injection nozzle.
Figure 21:
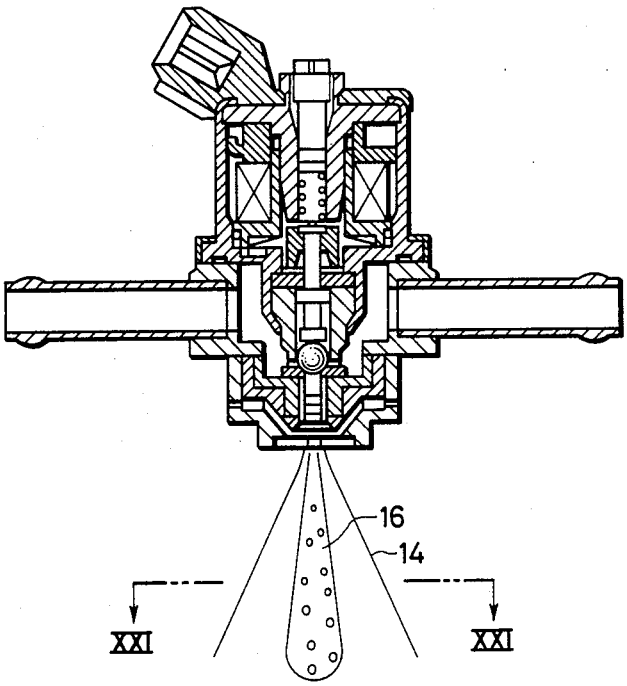
FIG. 21 PRIOR ART
FIG. 21 is a sectional view showing the injection of the conventional injection nozzle.
Figure 22:
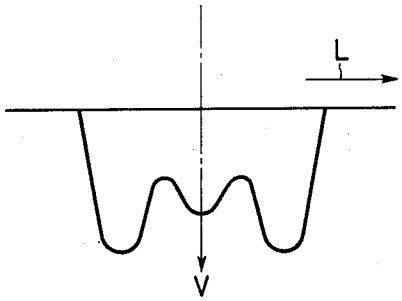
FIG. 22 PRIOR ART
FIG. 22 is a diagram showing a speed distribution in a section taken along line XXI—XXI in FIG. 21, in which the vertical axis represents speeds V around the axis of a fuel injection outlet, and the horizontal axis represents a radial position from the center of the injection.

FIG. 17 shows the injection nozzle of the fourth embodiments which is installed on a branch pipe of a suction manifold 76 extended from an air cleaner 72 to an engine 74. Since in the injection nozzle, the direction of fuel spray can be changed as shown in FIGS. 13 through 16, the injection nozzle can positively supply atomized fuel spray in equal quantities suction pipes 76A through 76D extended from the suction manifold 76 to the respective combustion chambers as shown in FIG. 19.

As is apparent from the above description, the direction and amount of jetted fuel can be adjusted by changing the configuration, direction and number of the fuel injection outlet 24 and the air jetting outlet 32.

Figure 18A:
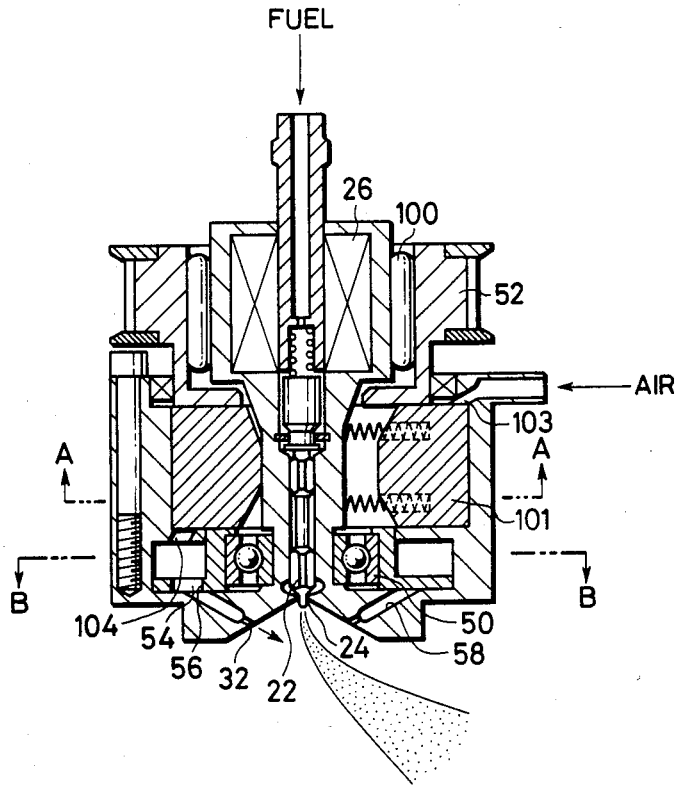
FIGS. 18(a), (b) and (c) are sectional views each showing the injection nozzle of the fifth embodiment.
Figure 18B:
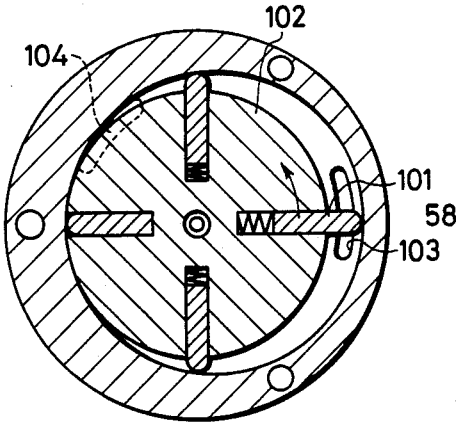
Figure 18C:
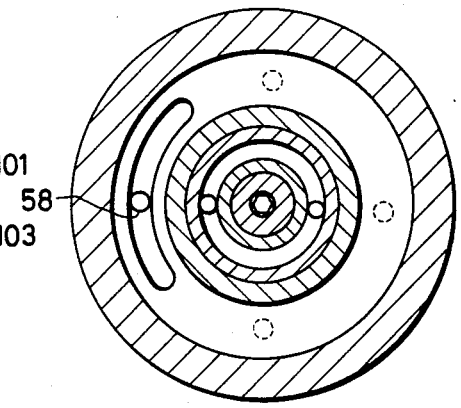

FIGS. 18(A), 18(B) and 18(C) show a fifth embodiment of the invention. The fuel injection nozzle has a pressurized fuel passage along its central axis. An injection nozzle body 22 fitted in the fuel passage is depressed by a spring to close the fuel nozzle. An electromagnetic solenoid 26 is provided around the fuel passage. A roller bearing 100 is provided around the solenoid 26, and a ball bearing 50 is provided around the injection nozzle body. These bearings support a rotor 102 having a timing pulley 52, a compressor, and control gas switching rotor (or rotary plate) 54. The rotor has the timing pulley 52 in the upper portion. The timing pulley 52 is used to transmit an external rotating drive force. The rotor has compressing vanes 101 in the middle portion, and has the control gas switching rotor (or rotary plate) 54 in the lower portion. As the rotor turns, each compressing vane 101 is slid on the inner wall of a casing by the centrifugal force and the elastic force. A slit extended over about 90° is cut in the control gas switching rotor. The axis of the inner cylinder of the casing is eccentric from the axis of the rotor so that the vanes are slid on the inner wall of the casing in such a manner that they are in close contact with the inner wall. A control gas suction port 103 is provided in the upper portion of the casing. A discharge outlet 104, an air chamber 105, and four control gas jetting outlets 58 communicated with the air chamber are provided below the control gas switching rotor.

As, in the fuel injection nozzle thus constructed, the timing pulley is driven through the timing belt by the crank shaft of the engine, the rotor is rotated, and therefore the vanes are turned while being in close contact with the inner wall of the casing. As a result, the air (employed as control gas in the embodiment) sucked in between the vanes, being compressed, is discharged into the air chamber through the discharge outlet provided below the vanes. The air chamber is provided around the rotor. Therefore, the compressed air in the air chamber is jetted only when the slot of the rotor is aligned with the control air jetting outlet 58 as the air switching rotor turns. The nozzles of the control air jetting outlets are opened towards the axis of the fuel injection nozzle, so that the control air collides obliquely with the jetted fuel. As a result, the fuel is atomized, and simultaneously the direction of the atomized fuel spray is bent along the direction of the air jetting outlet. As was described before, the slot in the control air switching rotor 102 is extended over about 90°, and the four air jetting outlets are provided below the rotor. Therefore, the four air jetting outlets jet the control air successively while the control air switching rotor makes one revolution (one air jetting outlet per ¼ revolution). On the other hand, in the fuel injection, the solenoid is energized in synchronization with rotation of the crank shaft, and the amount of injection is adjusted by controlling the timing of opening the injection nozzle, so that jetting the control air by the rotor and jetting the fuel are carried out in synchronization with each other. That is, in the fuel injection nozzle, jetting the fuel, compressing the air, and switching the control air jetting operations are integrally carried out. Therefore, air scarcely leaks from the rotor and the component around it, the power transmitting mechanism can be simplified, and the piping can be economically installed.

In the above-described fifth embodiment, the compressor is of vane type; however, a scroll type or rotary type compressor may be employed.

In the above-described fifth embodiment, the four air jetting outlets are opened on a circumference at equal intervals, and jets the air sequentially. However, the number of air jetting outlets and the order of operating the air jetting outlets can be freely changed by modifying the air jetting outlets, and furthermore the spray pattern can be also freely changed.

In the above-described embodiment, the air is employed as the control gas; however, the exhaust gas and hydrogen gas generated by a hydrogen gas generating apparatus can be also used.

As is apparent from the above description, in the fuel injection nozzle according to the invention, the fluid jetting outlets are provided in such a manner that the outlets are opened towards the jetted fuel from the periphery of the injection outlet, and the control means is used to control the jetted fluid. Therefore, atomization of the fluid is improved, and the direction of injection and the spray pattern can be controlled.

As the control fluid compressor is formed integrally in the injection nozzle, leakage of the control fluid, loss in the power transmission, and delay in response of the control fluid can be decreased.

We claim:

1. An injection nozzle for intermittently supplying fuel, said injection nozzle comprising:

a nozzle body, said nozzle body being disposed in a case, and said nozzle body being slidable with respect to said case along an axis of said nozzle body;

a fuel injection outlet provided at an output end of said case for jetting fuel therethrough and outside of said case when said nozzle body is lifted along the axis to open said fuel injection outlet, the fuel being jetted in a first direction;

at least first and second fluid jetting outlets, provided at the output end of said case and communicated through a fluid supply passage to fluid supply means, for intermittently jetting fluid therethrough towards the fuel thus jetted, the fluid being jetted from said first and second outlets in respective second and third directions each of which is transverse to said first direction so as to cause the jetted fluid to intersect and collide with the fuel outside of said case; and control means having at least one stationary opening and a movable opening for controlling timing of the supply of said fluid towards said intermittently jetted fuel by aligning said stationary and movable openings with each other when the fuel is jetted in response to lifting of said nozzle body, thereby dispersing said fuel by the kinetic energy of said fluid to improve the atomization of the fuel, and changing the direction of the jetted fuel to supply the fuel where desired.

2. An injection nozzle as claimed in claim 1, further comprising a rotary member arranged near said fuel injection outlet, in which said movable opening is formed as a part thereof.

3. An injection nozzle as claimed in claim 2, in which a plurality of said stationary openings are provided in the vicinity of said fuel injection outlet, and are aligned with said movable opening one after another.

4. An injection nozzle as claimed in claim 2, in which said movable opening is arranged coaxially with said fuel injection outlet.

5. An injection nozzle as claimed in claim 4, in which a plurality of said stationary openings are provided around said fuel injection outlet, and are aligned with said movable opening one after another.

6. An injection nozzle as claimed in claim 1, in which said fluid supply means is a compressor provided within said case and comprising:

a stationary casing arranged around the axis of said nozzle body and upstream of said movable opening;

a movable member movably incorporated in said casing; and a compression chamber having a variable volume, which is defined between said casing and said movable member and communicated with a fluid inlet and said movable opening.

7. An injection nozzle as claimed in claim 6, in which said compressor is of a rotary type, and is driven integrally with said rotary member having said movable opening.

8. An injection nozzle as claimed in claim 6, in which said compressor is of a rotary type, and is driven in synchronization with said rotary member having said movable opening.

9. An intermittent injection nozzle as claimed in claim 1, wherein the opening area of said movable opening is made larger than that of said stationary opening to jet the fluid in response to the injection of the fuel.

* * * * *

UNITED STATES PATENT AND TRADEMARK OFFICE

CERTIFICATE OF CORRECTION

PATENT NO. : 4,676,216

DATED : June 30, 1987

INVENTOR(S) : Katsuki Ohsawa et al

It is certified that error appears in the above-identified patent and that said Letters Patent is hereby corrected as shown below:

Page 1, below the line reading "Oct. 5, 1984 [JP] Japan ..... 59-209550" insert --Sept. 13, 1985 [JP] Japan ..... 60-141115--.

Signed and Sealed this

Sixteenth Day of August, 1988

*Attest:*

DONALD J. QUIGG

*Attesting Officer*

*Commissioner of Patents and Trademarks*